US009138860B2

(12) United States Patent
Dhandapani et al.

(10) Patent No.: US 9,138,860 B2
(45) Date of Patent: Sep. 22, 2015

(54) CLOSED-LOOP CONTROL FOR IMPROVED POLISHING PAD PROFILES

(75) Inventors: Sivakumar Dhandapani, San Jose, CA (US); Jun Qian, Sunnyvale, CA (US); Christopher D. Cocca, Fremont, CA (US); Jason G. Fung, Sunnyvale, CA (US); Shou-Sung Chang, Mt. View, CA (US); Charles C. Garretson, Sunnyvale, CA (US); Gregory E. Menk, Pleasanton, CA (US); Stan D. Tsai, Fremont, CA (US)

(73) Assignee: APPLIED MATERIALS, INC., Santa Clara, CA (US)

( * ) Notice: Subject to any disclaimer, the term of this patent is extended or adjusted under 35 U.S.C. 154(b) by 265 days.

(21) Appl. No.: 13/087,180

(22) Filed: Apr. 14, 2011

(65) Prior Publication Data

US 2011/0256812 A1 Oct. 20, 2011

Related U.S. Application Data

(60) Provisional application No. 61/325,986, filed on Apr. 20, 2010.

(51) Int. Cl.

| | |
|---|---|
| ***B24B 53/02*** | (2012.01) |
| ***B24B 53/017*** | (2012.01) |
| ***B24B 37/04*** | (2012.01) |

(52) U.S. Cl.

CPC ..... *B24B 53/017* (2013.01); *B24B 37/042* (2013.01)

(58) Field of Classification Search

CPC ..... B24B 53/017; B24B 37/042
USPC ..... 451/5, 6, 8, 9, 10
See application file for complete search history.

(56) References Cited

U.S. PATENT DOCUMENTS

| | | | |
|---|---|---|---|
| 5,974,679 | A | 11/1999 | Birang et al. |
| 6,040,244 | A | 3/2000 | Arai et al. |
| 6,045,434 | A | 4/2000 | Fisher, Jr. et al. |
| 6,186,864 | B1 | 2/2001 | Fisher, Jr. et al. |
| 6,488,573 | B1 | 12/2002 | Kobayashi et al. |

(Continued)

FOREIGN PATENT DOCUMENTS

| | | | |
|---|---|---|---|
| CN | 1979359 | A | 6/2007 |
| CN | 202894742 | U | 4/2013 |

(Continued)

OTHER PUBLICATIONS

International Search Report and Written Opinion mailed Dec. 9, 2011 in PCT/US2011/032447.
International Preliminary Report on Patentability for International Application No. PCT/US2011/032447 dated Oct. 23, 2012.
Japanese Office Action for Japanese Application No. 2013-506182 dated Nov. 25, 2014.

(Continued)

*Primary Examiner* — Joseph J Hail
*Assistant Examiner* — Joel Crandall
(74) *Attorney, Agent, or Firm* — Patterson & Sheridan, LLP

(57) ABSTRACT

Embodiments described herein use closed-loop control (CLC) of conditioning sweep to enable uniform groove depth removal across the pad, throughout pad life. A sensor integrated into the conditioning arm enables the pad stack thickness to be monitored in-situ and in real time. Feedback from the thickness sensor is used to modify pad conditioner dwell times across the pad surface, correcting for drifts in the pad profile that may arise as the pad and disk age. Pad profile CLC enables uniform reduction in groove depth with continued conditioning, providing longer consumables lifetimes and reduced operating costs.

20 Claims, 7 Drawing Sheets

(56) References Cited

U.S. PATENT DOCUMENTS

| | | | | |
|---|---|---|---|---|
| 6,616,513 | B1 | 9/2003 | Osterheld | |
| 6,661,224 | B1 | 12/2003 | Linder | |
| 6,835,116 | B2 * | 12/2004 | Oguri et al. | 451/8 |
| 6,872,132 | B2 | 3/2005 | Elledge et al. | |
| 7,070,479 | B2 * | 7/2006 | Faustmann et al. | 451/21 |
| 7,128,803 | B2 * | 10/2006 | Owczarz et al. | 156/345.13 |
| 7,195,536 | B2 * | 3/2007 | Swedek et al. | 451/5 |
| 7,306,506 | B2 * | 12/2007 | Elledge | 451/5 |
| 7,314,401 | B2 * | 1/2008 | Chandrasekaran | 451/10 |
| 7,413,986 | B2 * | 8/2008 | Paik | 438/690 |
| 7,840,305 | B2 | 11/2010 | Behr et al. | |
| 8,043,870 | B2 | 10/2011 | Manens et al. | |
| 8,078,419 | B2 * | 12/2011 | Kobayashi et al. | 702/64 |
| 8,182,709 | B2 * | 5/2012 | Heinrich et al. | 216/84 |
| 2003/0186627 | A1 * | 10/2003 | So | 451/56 |
| 2006/0196283 | A1 * | 9/2006 | Yang et al. | 73/865.9 |
| 2006/0226123 | A1 * | 10/2006 | Birang | 216/88 |
| 2009/0137190 | A1 * | 5/2009 | Togawa et al. | 451/8 |
| 2009/0191797 | A1 * | 7/2009 | Nabeya et al. | 451/54 |
| 2009/0280850 | A1 | 11/2009 | Mathur et al. | |
| 2009/0318060 | A1 | 12/2009 | Dhandapani et al. | |

FOREIGN PATENT DOCUMENTS

| | | | |
|---|---|---|---|
| CN | 103676773 | A | 3/2014 |
| EP | 1063056 | A2 | 12/2000 |
| JP | 2001129754 | A | 5/2001 |
| JP | 2009148876 | A | 7/2009 |
| KR | 10-0223953 | | 7/1999 |
| KR | 10-0286415 | | 3/2001 |
| KR | 10-2001-0050233 | | 6/2001 |
| KR | 10-0289985 | | 7/2002 |
| KR | 10-2007-0115259 | | 12/2007 |
| TW | I275451 | B | 3/2007 |
| TW | 200819243 | A | 5/2008 |
| WO | WO 99/03639 | | 1/1999 |
| WO | 2009137764 | A2 | 11/2009 |

OTHER PUBLICATIONS

Chinese Office Action (with attached English translation) for Application No. 201180007366.6 dated Feb. 13, 2015; 13 total pages.

Search Report and Office Action for Taiwan Application No. 100113575 dated Mar. 23, 2015.

* cited by examiner

CLOSED-LOOP CONTROL FOR IMPROVED POLISHING PAD PROFILES

CROSS-REFERENCE TO RELATED APPLICATIONS

This application claims benefit of U.S. provisional patent application Ser. No. 61/325,986, filed Apr. 20, 2010, which is herein incorporated by reference in its entirety.

BACKGROUND OF THE INVENTION

1. Field of the Invention

Embodiments described herein generally relate to the planarization of substrates. More particularly, the embodiments described herein relate to the conditioning of polishing pads.

2. Description of the Related Art

Sub-quarter micron multi-level metallization is one of the key technologies for the next generation of ultra large-scale integration (ULSI). The multilevel interconnects that lie at the heart of this technology require planarization of interconnect features formed in high aspect ratio apertures, including contacts, vias, trenches and other features. Reliable formation of these interconnect features is very important to the success of ULSI and to the continued effort to increase circuit density and quality on individual substrates and die.

Multilevel interconnects are formed using sequential material deposition and material removal techniques on a substrate surface to form features therein. As layers of materials are sequentially deposited and removed, the uppermost surface of the substrate may become non-planar across its surface and require planarization prior to further processing. Planarization or "polishing" is a process in which material is removed from the surface of the substrate to form a generally even, planar surface. Planarization is useful in removing excess deposited material, removing undesired surface topography, and surface defects, such as surface roughness, agglomerated materials, crystal lattice damage, scratches, and contaminated layers or materials to provide an even surface for subsequent photolithography and other semiconductor manufacturing processes.

Chemical Mechanical Planarization, or Chemical Mechanical Polishing (CMP), is a common technique used to planarize substrates. CMP utilizes a chemical composition, such as slurries or other fluid medium, for selective removal of materials from substrates. In conventional CMP techniques, a substrate carrier or polishing head is mounted on a carrier assembly and positioned in contact with a polishing pad in a CMP apparatus. The carrier assembly provides a controllable pressure to the substrate, thereby pressing the substrate against the polishing pad. The pad is moved relative to the substrate by an external driving force. The CMP apparatus affects polishing or rubbing movements between the surface of the substrate and the polishing pad while dispersing a polishing composition to affect chemical activities and/or mechanical activities and consequential removal of materials from the surface of the substrate.

The polishing pad performing this removal of material must have the appropriate mechanical properties for substrate planarization while minimizing the generation of defects in the substrate during polishing. Such defects may be scratches in the substrate surface caused by raised areas of the pad or by polishing by-products disposed on the surface of the pad, such as accumulation of conductive material removed from the substrate precipitating out of the electrolyte solution, abraded portions of the pad, agglomerations of abrasive particles from polishing slurries, and the like. The polishing potential of the polishing pad generally lessens during polishing due to wear and/or accumulation of polishing by-products on the pad surface, resulting in reduced polishing qualities. This alteration of the polishing pad may occur in a non-uniform or localized pattern across the pad surface, which may promote uneven planarization of the conductive material. Thus, the pad surface must periodically be refreshed, or conditioned, to restore the polishing performance of the pad.

Therefore, there is a need for improved methods and apparatus for conditioning polishing pads.

SUMMARY OF THE INVENTION

Embodiments described herein generally relate to the planarization of substrates. More particularly, the embodiments described herein relate to the conditioning of polishing pads. In one embodiment, a method of conditioning a polishing pad is provided. The method comprises contacting a surface of the polishing pad with a conditioning disk, measuring a thickness of the polishing pad while sweeping the conditioning disk across the surface of the polishing pad, comparing the measured thickness of the polishing pad to a standard thickness polishing pad profile, and adjusting a dwell time of the conditioning disk based on the comparison of the measured thickness of the polishing pad to the standard thickness polishing pad profile.

In another embodiment, a method of conditioning a polishing pad is provided. The method comprises conditioning a polishing pad using an initial conditioning recipe while measuring a thickness of the polishing pad using an integrated inductive sensor, wherein the initial conditioning recipe comprises an initial sweep schedule based on an initial dwell time profile, comparing the measured thickness of the polishing pad to an initial pre-polishing pad thickness profile and using the difference to construct a measured pad wear profile, comparing the measured pad wear profile to a target pad wear profile, determining a revised dwell time profile based on the comparison of the measured pad wear profile to a target pad wear profile, developing a revised sweep schedule based on the revised dwell time profile, and adjusting a dwell time of the conditioning disk based on the revised sweep schedule.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Figure 1:
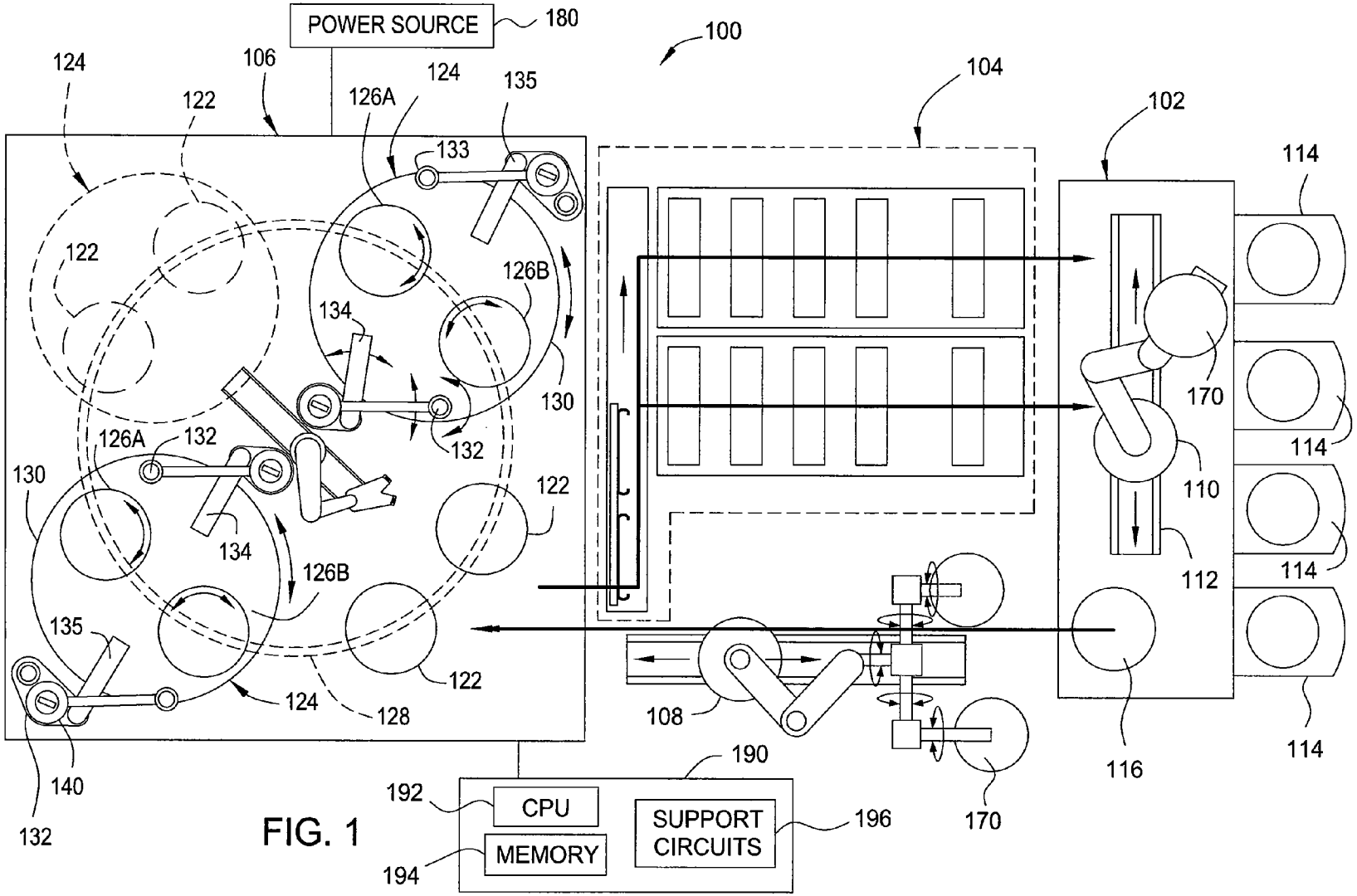
FIG. 1 is a is a top schematic plan view of one embodiment of a chemical mechanical polishing (CMP) system.

Embodiments described herein generally provide methods and apparatus for the planarization of substrates. More particularly, the embodiments described herein provide methods and apparatus for the conditioning of polishing pads. Chemical mechanical planarization (CMP) pads require conditioning to maintain the surfaces yielding acceptable performance. However, conditioning not only regenerates the pad surface but also wears away the pad material and slurry transport grooves. Non-acceptable conditioning may result in non-uniform pad profiles, limiting the productive lifetimes of pads. Certain embodiments described herein use closed-loop control (CLC) of conditioning sweep to enable uniform groove depth removal across the pad, throughout pad life. A sensor may be integrated into the conditioning arm to enable in-situ and real-time monitoring of the thickness of the pad stack. Feedback from the thickness sensor may be used to modify pad conditioner dwell times across the pad surface, correcting for drifts in the pad profile that may arise as the pad and disk age. Pad profile CLC enables uniform reduction in groove depth with continued conditioning, providing longer consumables lifetimes and reduced operating costs.

Pad conditioning is used extensively in CMP to maintain acceptable process performance. On-wafer thin film material removal rates (MRR) deteriorate rapidly without periodic pad surface conditioning with an abrasive disk. Appropriate conditioning intervals are also required to maintain acceptable within-wafer non-uniformity (WIWNU) and defectivity throughout the life of a pad or pad set. However, conditioning not only regenerates but also wears away the pad top surface, including grooves used for slurry distribution. The effective lifetime of a pad can be reduced if the grooves are worn away unevenly. Non-acceptable conditioning may result in non-uniform pad profiles that limit the productive lifetimes of pads. Pad profile non-uniformity can have a significant impact on tool operating costs due to consumables replacement and subsequent process re-qualification.

The pad conditioning sweep schedule is one of the most significant factors affecting pad profile non-uniformity. For a rotary polishing tool, the across-platen travel of the conditioning disk is typically divided into radial conditioning zones. The residence time of the conditioning disk within each zone, or dwell time, can be adjusted to yield a desired sweep schedule. Typically, linear and sinusoidal sweep schedules which are fixed are commonly used. However, fixed sweep schedules often fail to correct for process drift and variations in the consumables (e.g., slurry) used.

Models designed to predict dwell time profiles yielding superior within-pad wear profile performance have been tested by measuring the pad stack thickness or groove depth profiles for extensively conditioned pads. Pad thickness profile measurements are not usually performed during polishing operations since they tend to be intrusive and are often destructive in nature. Currently conditioner sweep schedules are static, and once established do not self-adjust in response to process drift.

Embodiments described herein provide a closed-loop control method for correcting within-platen pad wear non-uniformity. A non-contacting sensor integrated into the pad conditioning arm may be used to monitor pad thickness or removal profiles both during active conditioning and independently of conditioning and polishing operations. Feedback from the integrated sensor is sent to an advanced process control (APC) system or controller, which compares the measured pad removal profile to a target removal profile. The APC system then modifies the conditioner dwell times for each zone in the sweep schedule to correct for deviations from the target pad wear profile. The closed-loop control method is expected to be insensitive to differences in disk design, front-side flatness and conditioning wear rate. The method can correct for non-acceptable initial sweep profile settings or for drift in the pad profile that may arise as the pad and disk age, enabling uniform within-pad wear profiles to be maintained throughout pad life. The method can also correct for variability in consumables such as slurries and disk-to-disk and pad-to-pad variation.

While the particular apparatus in which the embodiments described herein can be practiced is not limited, it is particularly beneficial to practice the embodiments in a Reflexion GT™ system, REFLEXION® LK CMP system, and MIRRA MESA® system sold by Applied Materials, Inc., Santa Clara, Calif. Additionally, CMP systems available from other manufacturers may also benefit from embodiments described herein. Embodiments described herein may also be practiced on overhead circular track polishing systems including the overhead track polishing systems described in commonly assigned U.S. patent application Ser. No. 12/420,996, titled POLISHING SYSTEM HAVING A TRACK, filed Apr. 9, 2009, now published as US 2009/0258574, which is hereby incorporated by reference in its entirety.

FIG. 1 is a top plan view illustrating one embodiment of a chemical mechanical polishing ("CMP") system 100. The CMP system 100 includes a factory interface 102, a cleaner 104 and a polishing module 106. A wet robot 108 is provided to transfer substrates 170 between the factory interface 102 and the polishing module 106. The wet robot 108 may also be configured to transfer substrates between the polishing module 106 and the cleaner 104. The factory interface 102 includes a dry robot 110 which is configured to transfer substrates 170 between one or more cassettes 114 and one or more transfer platforms 116. In one embodiment depicted in FIG. 1, four substrate storage cassettes 114 are shown. The dry robot 110 has sufficient range of motion to facilitate transfer between the four cassettes 114 and the one or more transfer platforms 116. Optionally, the dry robot 110 may be mounted on a rail or track 112 to position the robot 110 laterally within the factory interface 102, thereby increasing the range of motion of the dry robot 110 without requiring large or complex robot linkages. The dry robot 110 additionally is configured to receive substrates from the cleaner 104 and return the clean polished substrates to the substrate storage cassettes 114. Although one substrate transfer platform 116 is shown in the embodiment depicted in FIG. 1, two or more substrate transfer platforms may be provided so that at least two substrates may be queued for transfer to the polishing module 106 by the wet robot 108 at the same time.

Still referring to FIG. 1, the polishing module 106 includes a plurality of polishing stations 124 on which substrates are polished while retained in one or more carrier heads 126A, 126B. The polishing stations 124 are sized to interface with two or more carrier heads 126A, 126B simultaneously so that polishing of two or more substrates may occur using a single polishing station 124 at the same time. The carrier heads 126A, 126B are coupled to a carriage (not shown) that is mounted to an overhead track 128 that is shown in phantom in FIG. 1. The overhead track 128 allows the carriage to be selectively positioned around the polishing module 106 which facilitates positioning of the carrier heads 126A, 126B selectively over the polishing stations 124 and load cup 122. In the embodiment depicted in FIG. 1, the overhead track 128 has a circular configuration which allows the carriages retaining the carrier heads 126A, 126B to be selectively and independently rotated over and/or clear of the load cups 122 and the polishing stations 124. The overhead track 128 may have other configurations including elliptical, oval, linear or other suitable orientation and the movement of the carrier heads 126A, 126B may be facilitated using other suitable devices.

In one embodiment, as depicted in FIG. 1, two polishing stations 124 are shown located in opposite corners of the polishing module 106. At least one load cup 122 is in the corner of the polishing module 106 between the polishing stations 124 closest to the wet robot 108. The load cup 122 facilitates transfer between the wet robot 108 and the carrier heads 126A, 126B. Optionally, a third polishing station 124 (shown in phantom) may be positioned in the corner of the polishing station 124 opposite the load cups 122. Alternatively, a second pair of load cups 122 (also shown in phantom) may be located in the corner of the polishing module 106 opposite the load cups 122 that are positioned proximate the wet robot. Additional polishing stations 124 may be integrated in the polishing module 106 in systems having a larger footprint.

Each polishing station 124 includes a polishing pad 200 (See FIG. 2) having a polishing surface 130 capable of polishing at least two substrates at the same time and a matching number of polishing units for each of the substrates. Each of the polishing units includes one or more carrier heads 126A, 126B, a conditioning module 132 and a polishing fluid delivery module 134. In one embodiment, the conditioning module 132 may comprise a pad conditioning assembly 140 which dresses the polishing surface 130 of the polishing pad 200 by removing polishing debris and opening the pores of the pad. In another embodiment, the polishing fluid delivery module 134 may comprise a slurry delivery arm. In one embodiment, each polishing station 124 comprises multiple pad conditioning assemblies 132, 133. In one embodiment, each polishing station 124 comprises multiple fluid delivery arms 134, 135 for the delivery of a fluid stream to each polishing stations 124. The polishing pad 200 is supported on a platen assembly 240 (see FIG. 2) which rotates the polishing surface 130 during processing. In one embodiment, the polishing surface 130 is suitable for at least one of a chemical mechanical polishing and/or an electrochemical mechanical polishing process. In another embodiment, the platen may be rotated during polishing at a rate from about 10 rpm to about 150 rpm, for example, about 50 rpm to about 110 rpm, such as about 80 rpm to about 100 rpm. The system 100 is coupled with a power source 180.

Figure 2:
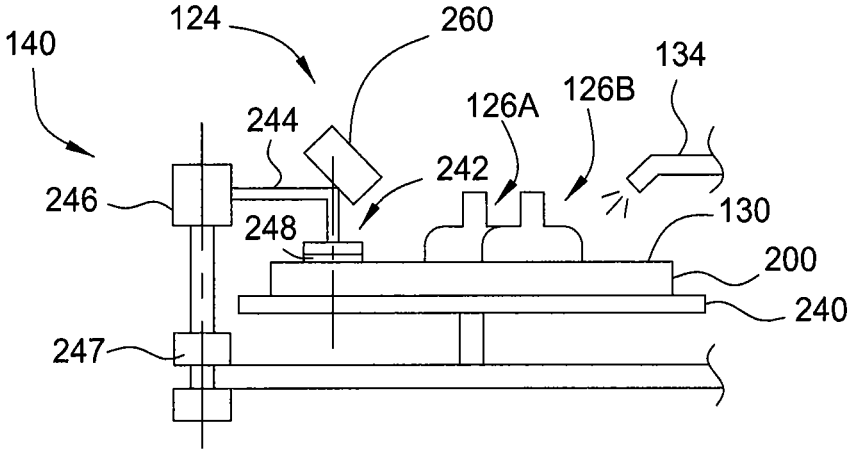
FIG. 2 is a partial perspective view of a polishing station of the CMP system of FIG. 1.

FIG. 2 is a partial perspective view of a polishing station 124 having a conditioning module 132 according to embodiments described herein. Each conditioning module 132 includes a pad conditioning assembly 140. In one embodiment, the pad conditioning assembly 140 comprises a conditioning head 242 supported by a support assembly 246 with a conditioning arm 244 therebetween. In one embodiment, the pad conditioning assembly 140 further comprises a displacement sensor 260 coupled with the conditioning arm 244. In another embodiment, the displacement sensor 260 may be coupled with the conditioning head 242.

The support assembly 246 is adapted to position the conditioning head 242 in contact with the polishing surface 130, and further is adapted to provide a relative motion therebetween. The conditioning arm 244 has a distal end coupled to the conditioning head 242 and a proximal end coupled to the base 247. The base 247 rotates to sweep the conditioning head 242 across the polishing surface 130 to condition the polishing surface 130. As a result of the relative motion of the conditioning head 242 with respect to the polishing surface 130 of the polishing pad 200, the displacement sensor 260 takes thickness measurements of the polishing surface 130 and the polishing pad 200.

The sensor coupled to the conditioning arm allows a thickness of the polishing pad 200 to be measured at various points during a portion of a normal operation cycle, while the accompanying logic allows the measurement data to be captured and displayed. In some embodiments, the displacement sensor 260 may utilize an inductive sensor.

In embodiments where the displacement sensor 260 is a laser based sensor, the thickness of the polishing pad 200 is measured directly. The conditioning arm 244 is in a fixed position with respect to the platen 240, and the laser is in a fixed position with respect to the arm. Consequently, the laser is in a fixed position with respect to the platen assembly 240. By measuring the distance to the processing pad and calculating the difference between the distance to the polishing pad 200 and the distance to the platen assembly 240, the remaining thickness of the polishing pad 200 may be determined. In some embodiments, the resolution of the thickness measurement using the laser based displacement sensor 260 may be within 25 um.

In embodiments where the displacement sensor 260 is an inductive sensor, the thickness of the polishing pad 200 is measured indirectly. The conditioning arm 244 is actuated around a pivot point until the conditioning head 242 comes in contact with the processing pad 200. An inductive sensor, which emits an electromagnetic field, is mounted to the end of the pivot based conditioning arm 244. In accordance with Faraday's law of induction, the voltage in a closed loop is directly proportional to the change in the magnetic field per change in time. The stronger the applied magnetic field, the greater the eddy currents developed and the greater the opposing field. A signal from the sensor is directly related to the distance from the tip of the sensor to the metallic platen assembly 240. As the platen assembly 240 rotates, the conditioning head 242 rides on the surface of the pad and the inductive sensor rises and falls with the conditioning arm 244 according to the profile of the polishing pad 200. As the inductive sensor gets closer to the metallic platen assembly 240, an indication of processing pad wear, the voltage of the signal increases. The signal from the sensor is processed and captures the variation in the thickness of the polishing pad assembly 200. In some embodiments, the resolution of the thickness measurement using the inductive sensor 260 may be within 1 um.

The conditioning head 242 is also configured to provide a controllable pressure or downforce to controllably press the conditioning head 242 toward the polishing surface 130. In one embodiment, the down force can be in a range between about 0.5 $lb_f$ (22.2 N) to about 14 $lb_f$ (62.3 N), for example, between about 1 $lb_f$ (4.45 N) and about 10 $lb_f$ (44.5 N). The conditioning head 242 generally rotates and/or moves laterally in a sweeping motion across the polishing surface 130. In one embodiment, the lateral motion of the conditioning head 242 may be linear or along an arc in a range of about the center of the polishing surface 130 to about the outer edge of the polishing surface 130, such that, in combination with the rotation of the platen assembly 240, the entire polishing surface 130 may be conditioned. The conditioning head 242 may have a further range of motion to move the conditioning head 242 off of the platen assembly 240 when not in use.

The conditioning head 242 is adapted to house a conditioning disk 248 to contact the polishing surface 130. The conditioning disk 248 may be coupled with the conditioning head 242 by passive mechanisms such as magnets and pneumatic actuators that take advantage of the existing up and down motion of the conditioning arm 244. The conditioning disk 248 generally extends beyond the housing of the conditioning head 242 by about 0.2 mm to about 1 mm in order to contact the polishing surface 130. The conditioning disk 248 can be made of nylon, cotton cloth, polymer, or other soft material that will not damage the polishing surface 130. Alternatively, the conditioning disk 248 may be made of a textured polymer or stainless steel having a roughened surface with diamond particles adhered thereto or formed therein. The diamond particles may range in size between about 30 microns to about 100 microns.

To facilitate control of the polishing system 100 and processes performed thereon, a controller 190 comprising a central processing unit (CPU) 192, memory 194, and support circuits 196, is connected to the polishing system 100. The CPU 192 may be one of any form of computer processor that can be used in an industrial setting for controlling various drives and pressures. The memory 194 is connected to the CPU 192. The memory 194, or computer-readable medium, may be one or more of readily available memory such as random access memory (RAM), read only memory (ROM), floppy disk, hard disk, or any other form of digital storage, local or remote. The support circuits 196 are connected to the CPU 192 for supporting the processor in a conventional manner. These circuits include cache, power supplies, clock circuits, input/output circuitry, subsystems, and the like.

Figure 3:
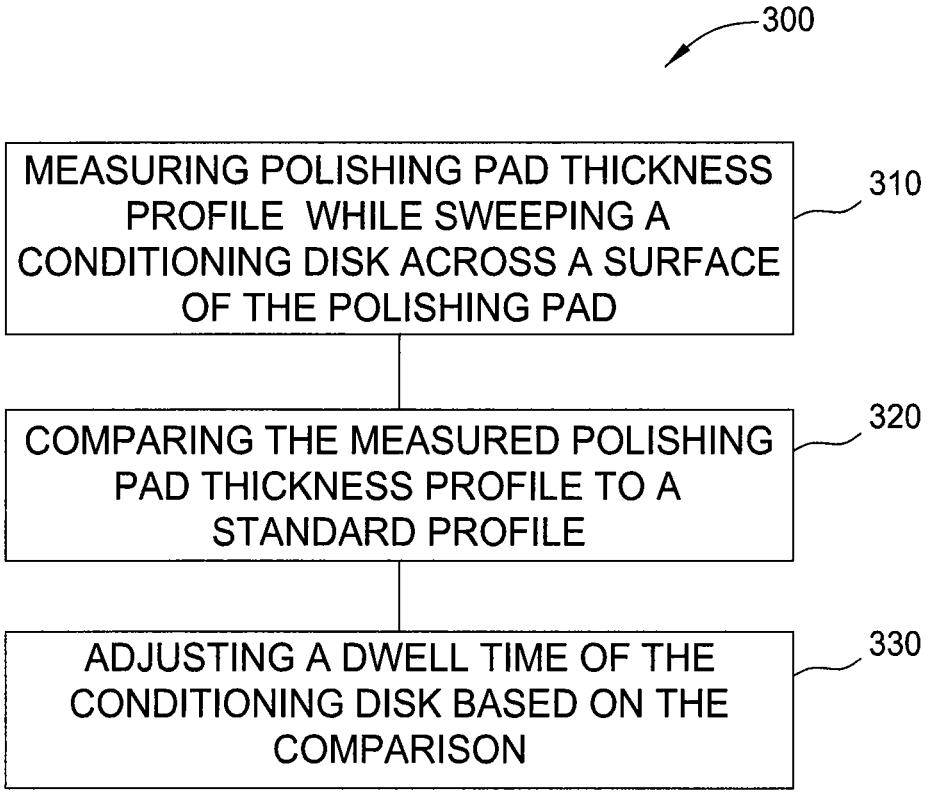
FIG. 3 is a flowchart depicting one embodiment of a pad conditioning method according to embodiments described herein.

FIG. 3 is a flowchart 300 depicting one embodiment of a pad conditioning method. The method depicted in flowchart 300 achieves a conditioning process which maintains a uniform polishing pad profile or corrects a non-uniform pad polishing profile throughout the useful life of the polishing pad. At block 310, polishing pad thickness is measured while sweeping a conditioning disk across a surface of the polishing pad. The polishing pad thickness may be measured using a displacement sensor, such as an inductive sensor as described herein. The measured polishing pad thickness may be used to create a measured polishing pad thickness profile.

At block 320, the measured polishing pad thickness is compared to a standard polishing pad thickness profile, which may be a target value. The standard polishing pad thickness profile may be determined based on a flat removal profile (e.g., the uniform reduction in groove depth of the polishing pad).

At block 330, an adjustment of the dwell time of the conditioning disk is made based on the comparison performed in block 320. The "dwell time" of the conditioning disk is defined as the residence time of the conditioning disk within each conditioning zone. If the measured polishing pad thickness for a particular region of the polishing pad is greater than the standard polishing pad thickness, the dwell time of the conditioning disk will be increased for that particular conditioning zone during a polishing sweep. If the measured polishing pad thickness for a particular conditioning zone of the polishing pad is less than the standard polishing pad thickness, the dwell time of the conditioning disk will be decreased for that particular conditioning zone during the polishing sweep. Conditioning of the polishing surface may take place exclusively while a substrate is being processed (in-situ conditioning), may proceed between processing of substrates (ex-situ conditioning), or may be independent of conditioning. In some embodiments, conditioning may be continuous as substrates are positioned on the apparatus, processed, and removed from the apparatus (mixed conditioning). In other embodiments, conditioning may start before, during, or after polishing, and may end before, during, or after polishing.

Figure 4:
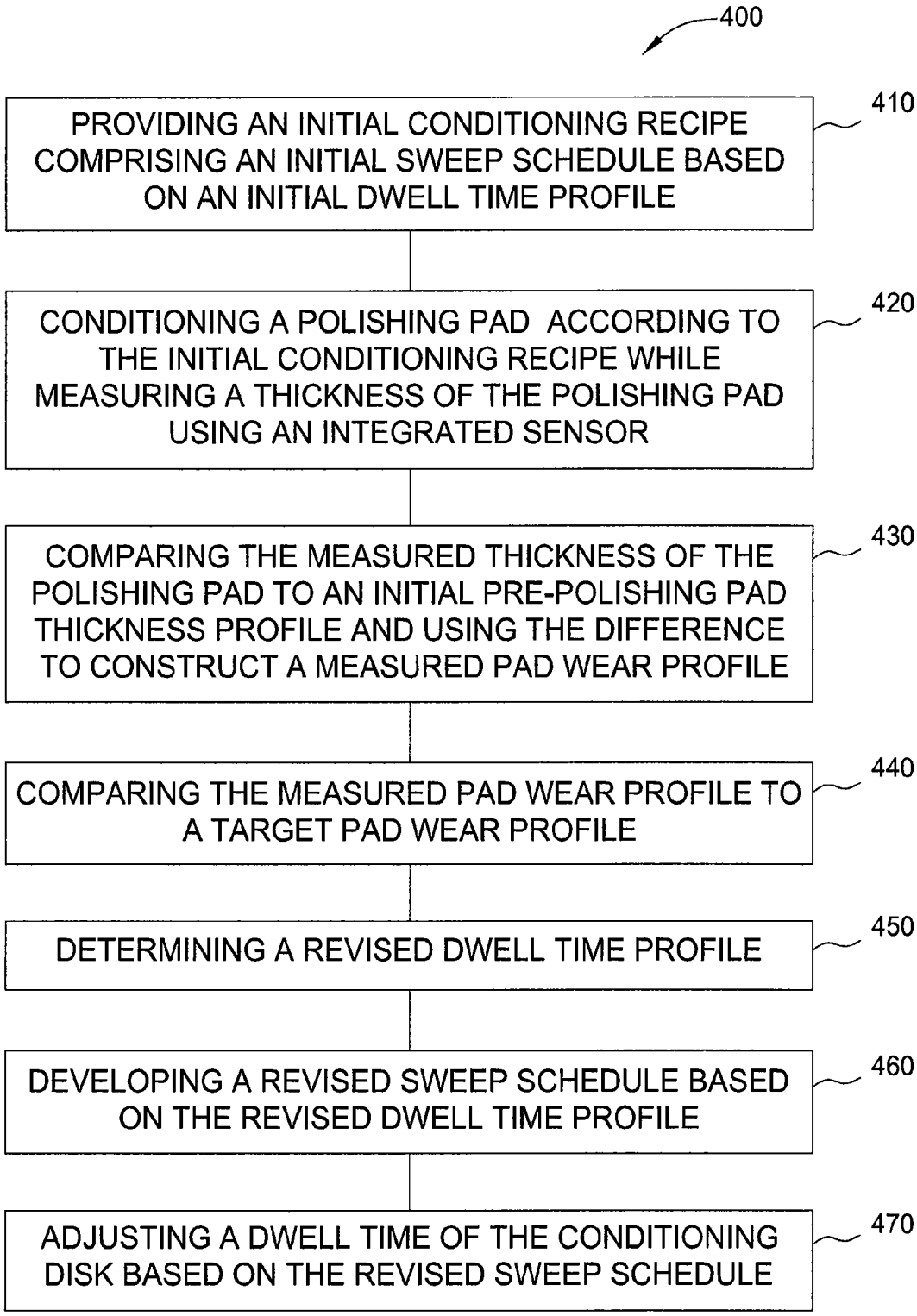
FIG. 4 is a flowchart depicting another embodiment of a pad conditioning method according to embodiments described herein.

FIG. 4 is a flowchart 400 depicting another embodiment of a pad conditioning method. The method depicted in flowchart 400 achieves a conditioning process which maintains a uniform polishing pad profile or corrects a non-uniform pad polishing profile throughout the useful life of the polishing pad. At block 410, an initial conditioning recipe comprising an initial sweep schedule based on an initial dwell time profile is provided. At block 420, a polishing pad is conditioned according to the initial conditioning recipe while measuring polishing pad thickness using an integrated sensor. The polishing pad may be conditioned while polishing a substrate on the polishing pad. At block 430, the measured thickness of the polishing pad is compared to an initial pre-polishing pad thickness profile and the difference between the two is used to construct a measured pad wear profile. At block 440, the measured pad wear profile is compared to a target pad wear profile. At block 450, a revised dwell time profile is determined based on the comparison of the measured pad wear profile to the target pad wear profile. At block 460, a revised sweep schedule based on the revised dwell time profile is developed. At block 470, a dwell time of the conditioning disk is adjusted based on the revised sweep schedule. A revised conditioning recipe based on the revised sweep schedule may be used for ex-situ, in-situ, or mixed conditioning of the polishing pad as additional substrates are processed.

EXAMPLE

The following non-limiting examples are provided to further illustrate embodiments described herein. However, the examples are not intended to be all inclusive and are not intended to limit the scope of the embodiments described herein.

Pad wear studies were conducted on a REFLEXION® LK 300 mm CMP system, available from Applied Materials, Inc. of Santa Clara, Calif., using IC1010 polyurethane pads, available from The Dow Chemical Company, and A165 diamond conditioning disks, available from 3M Corporation. The polisher was modified through the addition of a new pad conditioning arm design that features an integrated, non-contacting thickness sensor (See FIG. 2). Pad thickness measurements were collected as the pad conditioning arm was swept across the pad during conditioning. Pad wear profiles were also obtained from manual measurements of remaining groove depth of the polishing pad using a Mitutoyo Absolute Digimatic Indicator ("pin gauge") which is a depth gauge with a dial indicator and a small diameter wire stylus.

Experiments were conducted for conditioning-only (ex-situ conditioning) and conditioning-during-polish cases (in-situ polishing). The pads were wetted with deionized water during conditioning-only runs and SEMI-SPERSE® 12 or SEMI-SPERSE® 25 (diluted 1:1 with deionized water), available from Cabot Corp., was used for the polishing runs. In the latter case, thermally oxidized silicon wafers or quartz disks from Quartz Unlimited were polished using a high removal rate interlevel dielectric (ILD) process with carrier head speeds of 87 rpm and average membrane pressures of 4.5 psi. For all runs, the platen speed was 93 rpm.

Figure 5A:
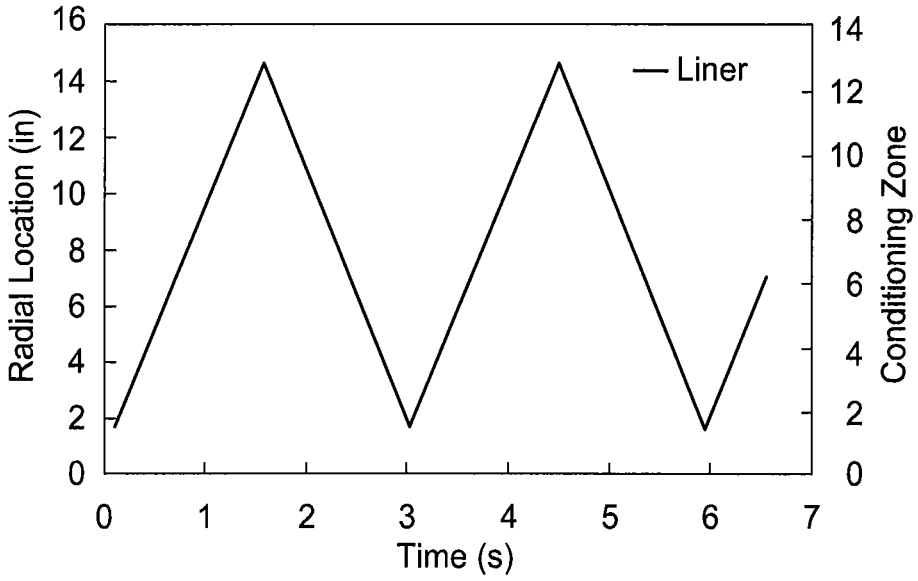
FIG. 5A (PRIOR ART)
FIG. 5A is a plot depicting a prior art linear pad conditioning sweep profile used for open loop runs.
Figure 5B:
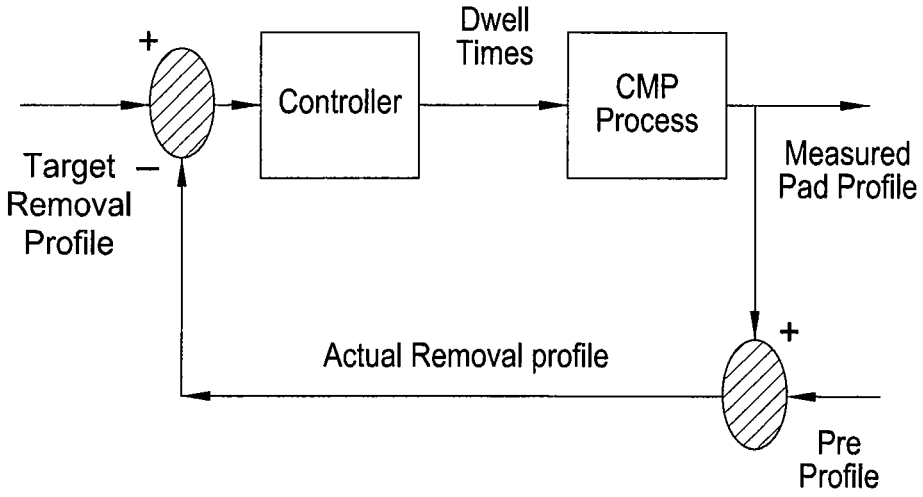
FIG. 5B is a schematic diagram of a pad profile CLC control model using pad profile feedback from an integrated sensor according to embodiments described herein.

The pad conditioner was operated with a head speed of 95 rpm and an applied load of 9 lb (4.08 kg). The sweep rate was 19 sweeps per minute, with a sweep range of 1.7 inches (4.32 cm) to 14.7 inches (37.3 cm) divided into 13 equidistant zones. Pad removal profiles were compared for conditioning with fixed linear sweep schedules run in an open-loop mode (See FIG. 5A) and adjustable sweep schedules under closed-loop control (See FIG. 5B) according to embodiments described herein. An initial, linear sweep schedule was set within the conditioning recipe. For open-loop control cases, the linear sweep schedule was maintained throughout the run. For closed-loop control cases, the sweep schedule was automatically updated based on feedback from the integrated sensor.

Conditioning-Only Runs

Figure 6A:
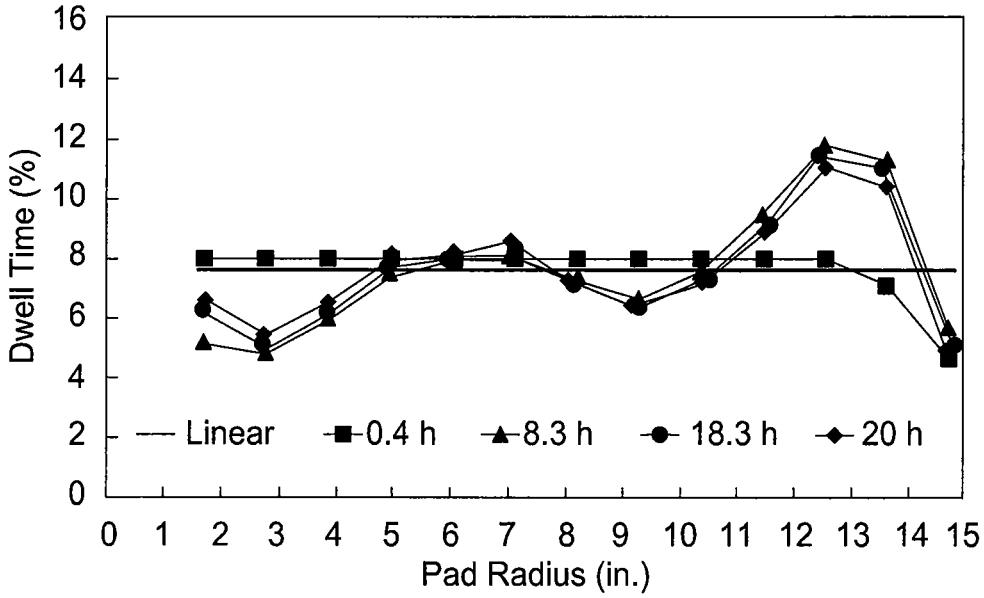
FIG. 6A is a plot depicting dwell time schedules for DIW conditioning runs.

IC1010 pads were subjected to more than 10 hours of conditioning in the open-loop, fixed dwell run, and to 22 hours of conditioning under closed-loop control of dwell times. During the conditioning-only runs, DI water was used and there was no substrate contact with the pad. As shown in FIG. 6A, the sweep schedules for the open-loop and closed-loop runs are initially identical and uniform (flat) across all zones. However, once the closed-loop control scheme is engaged it begins to minimize dwell times in the extreme pad edge zones to minimize wear at the outer edge of the pad. As the closed-loop control run progresses, relative dwell time increases in the near-edge zones and decreases in the zones near the center of the platen.

Figure 6B:
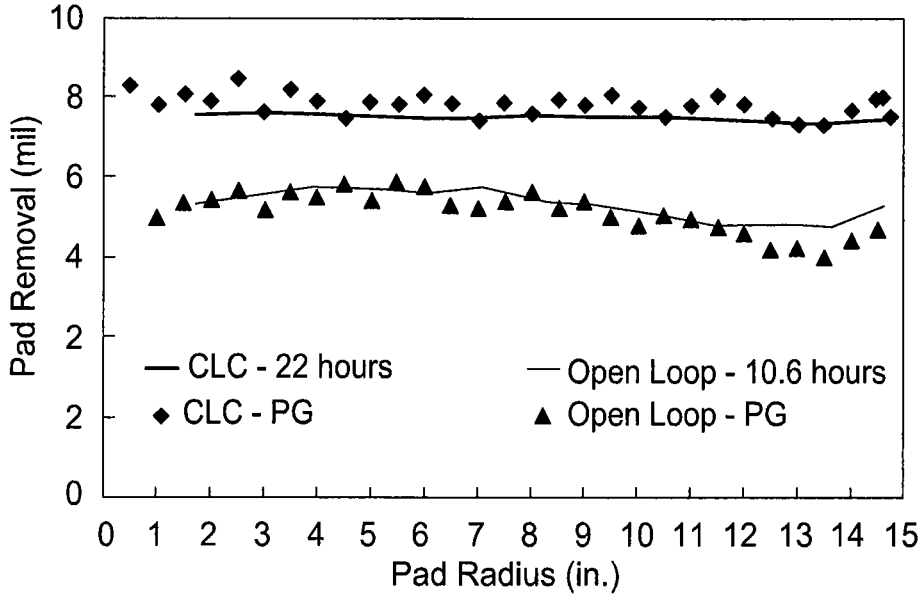
FIG. 6B is a plot depicting final pad removal profiles for open-loop and closed-loop control runs, comparing integrated sensor and pin gauge (PG) results.

The reason for this variation in dwell times is shown in FIG. 6B. For the open-loop case, pad removal is greatest closer to the platen center (approximately 3 inches (7.62 cm) to 6 inches (15.2 cm) from the platen center) and lowest in the near-edge region. The final dwell time profile for the closed-loop case is roughly the inverse of the final open-loop pad removal profile. The result of the closed-loop dwell time profile is a flat removal profile as observed in FIG. 6B. Good agreement (profile matching) is observed between pin gauge and integrated sensor measurements.

The useful pad lifetime is defined as the cumulative conditioning time for which the grooves in any region of the pad are worn down to 5 mils of depth remaining (e.g., 25 mils worn away for an initial groove depth of 30 mils). If the pad wear profile is not uniform, the fastest wearing region of the pad limits the useful pad lifetime rather than the average pad wear. As shown in FIG. 6B, the open-loop process has a pad wear maximum at about 5 inches (12.7 cm) from the center of the platen. It is this fast wear band that is lifetime limiting, even though substantial groove depth will still remain across the rest of the pad, especially near the platen edge. Closed-loop control yields a flat removal profile. The uniform reduction in groove depth provides an increase in pad lifetime.

Conditioning-During-Polishing Runs

Figure 7A:
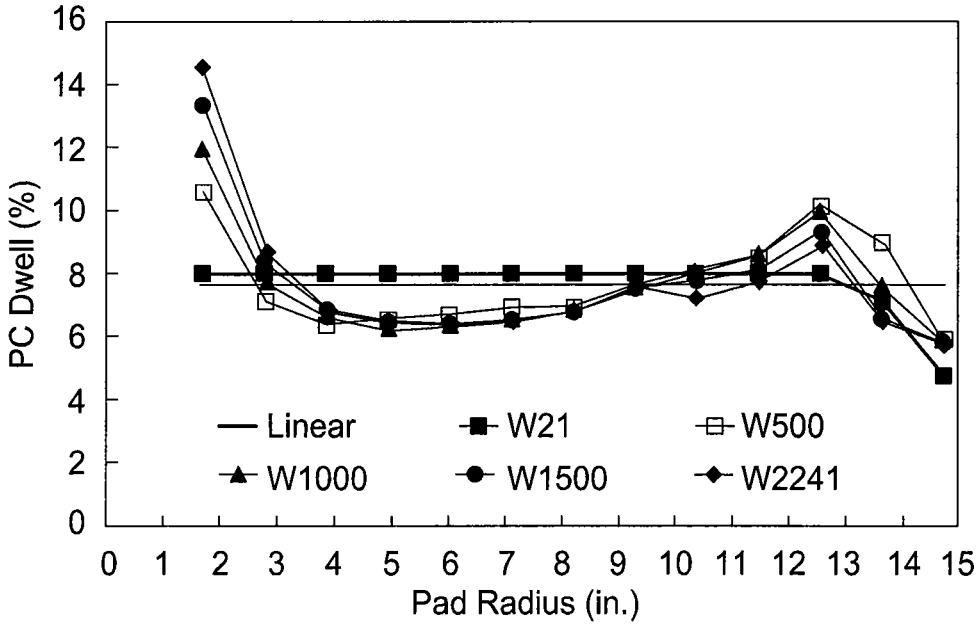
FIG. 7A is a plot depicting dwell time schedules for slurry polish conditioning runs according to embodiments described herein.

Conditioning during polishing yields within-pad removal profiles similar to those observed during conditioning alone. Results are compared for slurry polishing runs (e.g., silica slurry) on thermal oxide substrates or quartz disks, one in open-loop mode and one in closed-loop control mode, both with over 2,000 wafers polished (>20 hours of conditioning time). Again, the initial sweep schedules for the open-loop and closed-loop runs are initially identical and uniform (flat) across all zones (See FIG. 7A). Once the closed-loop control scheme is engaged it begins to minimize dwell times in the extreme pad edge zones and near mid-radius, and increasing the dwell times in the near-edge region and also at platen center.

Figure 7B:
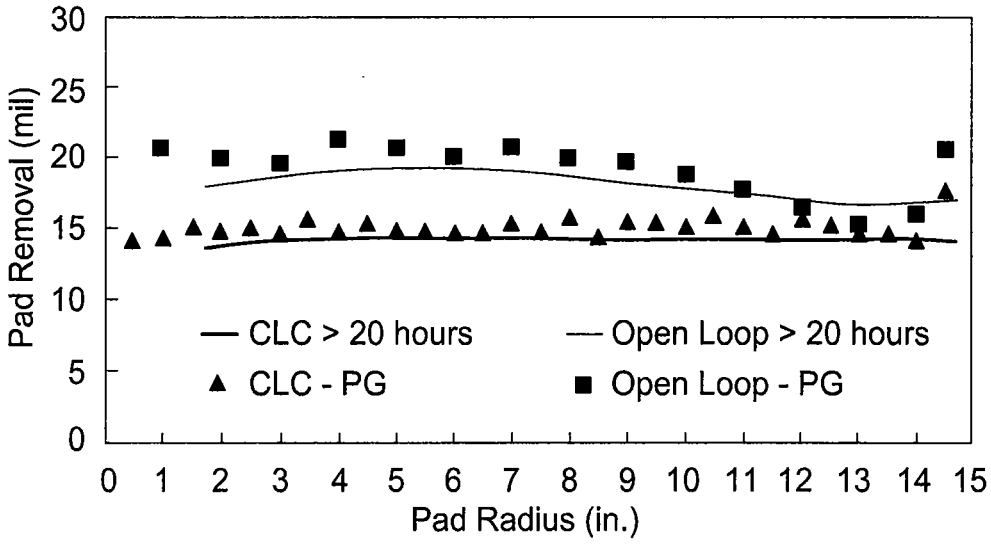
FIG. 7B is a plot depicting final pad removal profiles for open-loop and closed-loop control runs, comparing integrated sensor and pin gauge (PG) results according to embodiments described herein.

Pad wear results for the 2,000-wafer open-loop baseline run are presented in FIG. 7B. The non-uniformity profile is similar to that seen for conditioning-only runs with fixed dwells (FIG. 6B), except that the pad wear rate is faster at platen center. In order to maintain a flat pad removal profile, the closed-loop control system reduced dwell times for almost all of the mid-radius zones, while also increasing the dwell time of the center zone. Closed-loop control of the sweep schedule led to more uniform pad material removal with more uniform groove depth reduction. Closed-loop control of dwell times yielded a flat removal profile for more than 2,000 wafers polished. There is good agreement between pin gauge and integrated sensor measurements.

A comparison of pad profile non-uniformity ranges for the conditioning-only and conditioning during polish extended runs is presented in Table 1. As measured with the pin gauge, groove depth variation was reduced by more than 40% using closed-loop pad profile control. Integrated sensor measurements indicated a profile non-uniformity reduction of greater than 75%.

TABLE I

| Pad Conditioner Dwell Control | Pad Conditioning Time (h) | Average Pad Removal (mil) | Groove Depth Range (mil) Integrated Sensor (1.7-14.7 in.) | Groove Depth Range (mil) Pin Gauge (0-14.5 in.) |
|---|---|---|---|---|
| Conditioning-only runs: | | | | |
| Closed loop | 22 | 23.9 | 0.5 | 2.7 |
| Open loop | 10.6 | 18.4 | 2.4 | 4.5 |
| Polish runs: | | | | |
| Closed loop | >20 | 14.3 | 0.6 | 3.5 |
| Open loop | >20 | 18.3 | 2.6 | 5.9 |

Embodiments described herein provide a new approach to conditioning using closed-loop control (CLC) of conditioning sweep to enable uniform groove depth removal across the pad, throughout pad life. A non-contact sensor integrated into the conditioning arm enables the pad stack thickness to be monitored in-situ and in real time. Feedback from the thickness sensor is used to modify pad conditioner dwell times for each zone in the sweep schedule, correcting for drifts in the pad profile that may arise as the pad and disk age. Pad profile CLC enables uniform reduction in groove depth with continued conditioning, providing longer consumables lifetimes and reduced operating costs. Using closed-loop pad profile control, groove depth variation was reduced by more than 40% while useful pad life is predicted to increase by 20%.

Although certain embodiments herein are discussed in relation to grooved polishing pads, it should also be understood that the methods described herein are applicable to all non-metallic polishing pads including polishing pads without surface features and polishing pads with surface features (e.g., perforations, embossed surface features, etc.).

While the foregoing is directed to embodiments of the present invention, other and further embodiments of the invention may be devised without departing from the basic scope thereof, and the scope thereof is determined by the claims that follow.

The invention claimed is:

1. A method of conditioning a polishing pad positioned on a metallic platen assembly, comprising:

contacting a surface of the polishing pad with a conditioning disk housed in a conditioning head;

measuring a wear profile of a zone of the polishing pad while sweeping the conditioning disk across the surface of the polishing pad;

comparing the measured wear profile of the zone of the polishing pad to a target wear profile, wherein the target wear profile is non-planar; and adjusting a dwell time of the conditioning disk in the zone based on the comparison of the measured wear profile of the polishing pad to the target wear profile, wherein the wear profile of the polishing pad is measured using an inductive sensor coupled with a conditioning arm, wherein the inductive sensor is positioned a fixed non-zero distance from the conditioning disk, and wherein the conditioning arm has:

a distal end coupled with the conditioning head that houses the conditioning disk; and a proximal end coupled with a support assembly.

2. The method of claim 1, further comprising sweeping the conditioning disk across the surface of the polishing pad using the adjusted dwell time.

3. The method of claim 2, wherein the polishing pad is divided into conditioning zones and the dwell time of the conditioning disk is defined as the residence time of the conditioning disk within each conditioning zone.

4. The method of claim 3, wherein if the measured wear profile for a particular conditioning zone of the polishing pad is greater than the target wear profile, the dwell time of the conditioning disk will be increased for that particular conditioning zone during the conditioning sweep.

5. The method of claim 3, wherein if the measured wear profile for a particular conditioning zone of the polishing pad is less than the target wear profile, the dwell time of the conditioning disk will be decreased for that particular conditioning zone during the conditioning sweep.

6. The method of claim 2, wherein sweeping the conditioning disk across the surface of the polishing pad using the adjusted dwell time occurs in-situ while a substrate is being polished on the surface of the polishing pad.

7. The method of claim 2, wherein sweeping the conditioning disk across the surface of the polishing pad using the adjusted dwell time occurs ex-situ between the polishing of substrates.

8. The method of claim 2, wherein sweeping the conditioning disk across the surface of the polishing pad using the adjusted dwell time occurs as substrates are positioned on the polishing pad, processed, and removed from the polishing pad.

9. The method of claim 1, wherein a signal from the inductive sensor is directly related to a distance from a tip of the inductive sensor to the metallic platen assembly.

10. The method of claim 1, wherein the target pad profile is provided by an advanced process control system or controller.

11. A method of conditioning a polishing pad, comprising:

conditioning a polishing pad positioned on a metallic platen assembly using an initial conditioning recipe while measuring a thickness of the polishing pad using an integrated inductive sensor, wherein the initial conditioning recipe comprises an initial sweep schedule based on an initial dwell time profile and the conditioning of the polishing pad further comprises:

contacting a surface of one or more zones of the polishing pad with a conditioning disk housed in a conditioning head; and sweeping the conditioning disk across the surface of one or more zones of the polishing pad;

comparing the measured thickness of one or more zones of the polishing pad to an initial pre-polishing pad thickness profile and using the difference to construct a measured pad wear profile;

comparing the measured pad wear profile to a target pad profile, wherein the target pad profile is non-planar;

determining a revised dwell time profile based on the comparison of the measured pad wear profile to a target pad profile;

developing a revised sweep schedule based on the revised dwell time profile; and adjusting a dwell time of the conditioning disk for each of one or more zones of the polishing pad based on the revised sweep schedule, wherein the integrated inductive sensor is coupled with a conditioning arm, wherein the inductive sensor is positioned a fixed non-zero distance from the conditioning disk, and wherein the conditioning arm has:

a distal end coupled with the conditioning head that houses the conditioning disk; and a proximal end coupled with a support assembly: and wherein adjusting the dwell time is configured to alter the measured pad wear profile to achieve the target pad profile.

12. The method of claim 11, further comprising conditioning the polishing pad using the revised sweep schedule.

13. The method of claim 12, wherein conditioning the polishing pad using the revised sweep schedule occurs in-situ while a substrate is being polished on the surface of the polishing pad.

14. The method of claim 12, wherein conditioning the polishing pad using the revised sweep schedule occurs ex-situ between the polishing of substrates.

15. The method of claim 12, wherein conditioning the polishing pad using the revised sweep schedule occurs during one or more of the following: while substrates are positioned on the polishing pad, while substrates are processed, and while substrates are removed from the polishing pad.

16. The method of claim 11, wherein determining a revised dwell time profile comprises dividing the polishing pad into conditioning zones and the dwell time of the conditioning disk is defined as the residence time of the conditioning disk within each conditioning zone.

17. The method of claim 16, wherein if the measured pad wear profile for a particular conditioning zone of the polishing pad is greater than the target pad profile, the dwell time of the conditioning disk will be increased for that particular conditioning zone during the conditioning sweep.

18. The method of claim 16, wherein if the measured pad wear profile for a particular conditioning zone of the polishing pad is less than the target pad profile, the dwell time of the conditioning disk will be decreased for that particular conditioning zone during the conditioning sweep.

19. The method of claim 11, wherein a signal from the inductive sensor is directly related to a distance from a tip of the inductive sensor to the metallic platen assembly.

20. The method of claim 11, wherein the target pad profile is provided by an advanced process control system or controller.

* * * * *